US006203010B1

(12) United States Patent
Jorasch et al.

(10) Patent No.: US 6,203,010 B1
(45) Date of Patent: Mar. 20, 2001

(54) METHOD AND APPARATUS FOR A PROGRESSIVE JACKPOT DETERMINANT

(75) Inventors: James A. Jorasch, Stamford, CT (US); John M. Packes, Jr., Hawthorne, NY (US); Magdalena Mik, Greenwich, CT (US)

(73) Assignee: Walker Digital, LLC, Stamford, CT (US)

( * ) Notice: Subject to any disclaimer, the term of this patent is extended or adjusted under 35 U.S.C. 154(b) by 0 days.

(21) Appl. No.: 09/223,158

(22) Filed: Dec. 30, 1998

(51) Int. Cl.[7] ..... A63B 71/00

(52) U.S. Cl. ..... 273/138.1; 273/138 A; 273/143 R; 463/13; 463/20; 463/26; 463/27

(58) Field of Search ..... 273/138.1, 138 A, 273/138 R, 292, 143 R, 142 R; 463/20, 27, 13, 26, 16

(56) References Cited

U.S. PATENT DOCUMENTS 4,837,728 * 6/1989 Barrie et al. ..... 364/412
5,280,909 * 1/1994 Tracy ..... 273/138 A
5,375,830 * 12/1994 Takemoto et al. ..... 273/143 R
5,409,225 * 4/1995 Kelly et al. ..... 273/138 R
5,564,700 * 10/1996 Celona ..... 463/27
5,580,309 12/1996 Piechowiak et al. ..... 463/16
5,655,965 * 8/1997 Takemoto et al. ..... 463/20
5,695,188 * 12/1997 Ishibashi ..... 273/143 R
5,951,011 * 9/1999 Potter et al. ..... 273/292
5,980,384 * 11/1999 Barrie ..... 463/16
6,004,208 * 12/1999 Takemoto et al. ..... 463/20

FOREIGN PATENT DOCUMENTS 2 322 217 * 12/1997 (GB) ..... G07F/17/32

* cited by examiner

*Primary Examiner*—Jeanette Chapman
*Assistant Examiner*—D. Collins
(74) *Attorney, Agent, or Firm*—Steven M. Santisi

(57) ABSTRACT

A gaming device awards the players that hit the jackpot winning combination the base value of the progressive jackpot rather than the current amount. The progressive nature of the jackpot system does not affect a player's winning amount until after the win takes place. A player who wins the progressive jackpot of this invention receives a payout equal to the base value of the jackpot and subsequently continues to earn a percentage of the coins wagered at each of the machines linked to the progressive jackpot from his win until the next win.

80 Claims, 9 Drawing Sheets

212

| WINNER IDENTIFIER 300 | MACHINE IDENTIFIER 302 | TIME OF WIN 304 | BASE VALUE 306 | ACCUMULATED VALUE 308 | TOTAL JACKPOT WIN 310 |
|---|---|---|---|---|---|
| 1234 | 156247 | 7/21/95 | $1,000,000 | $1,208,995 | $2,208,995 |
| 9843 | 562348 | 3/18/96 | $1,000,000 | $2,593,118 | $3,593,118 |
| 2574 | 259987 | 6/20/98 | $1,000,000 | PENDING | N/A |

FIG. 3

210

| PLAYER IDENTIFIER 400 | NAME 402 | CONTACT METHOD 404 | UPDATE FREQUENCY 406 | SOCIAL SECURITY NUMBER 408 | STATUS 410 |
|---|---|---|---|---|---|
| 1234 | BOB LOWE | 10 MAIN ST. TOWN, USA | 1 / WEEK | 111-55-5632 | INACTIVE |
| 9843 | DAMASCUS LEK | LEK@AOL.COM | 1 / DAY | 112-94-4762 | INACTIVE |
| 2574 | DEAN GREENE | (555) 705-9999 | 1 / WEEK | 113-43-8314 | ACTIVE |

FIG. 4

210A

| PLAYER IDENTIFIER 800 | BASE VALUE 802 | 1ST SUBSEQUENT CYCLE WINNINGS (70%) 804 | 2ND SUBSEQUENT CYCLE WINNINGS (20%) 806 | 3RD SUBSEQUENT CYCLE WINNINGS (10%) 808 | TOTAL PROGRESSIVE JACKPOT TO DATE 810 |
|---|---|---|---|---|---|
| 1234 | $1,000,000 | $846,196.50 | $362,798.50 | PENDING | $2,208,995.00 |
| 9843 | $1,000,000 | $1,815,182.60 | PENDING | PENDING | $2,815,182.60 |
| 2574 | $1,000,000 | PENDING | PENDING | PENDING | $1,000,000.00 |

FIG. 8

METHOD AND APPARATUS FOR A PROGRESSIVE JACKPOT DETERMINANT

BACKGROUND OF THE INVENTION

1. Field of the Invention

The present invention relates generally to gaming systems and, more particularly, to gaming systems that involve progressive jackpots.

2. Discussion of the Related Art

A progressive jackpot gaming system typically includes multiple gaming machines linked together via a progressive controller, wherein each of the linked machines contributes a fraction of the "coin-in" or amount wagered, to a progressive jackpot and allows a player of that machine a chance to win the amount of the progressive jackpot. A progressive jackpot may also be built using the coin-in from a single machine. More generally a progressive jackpot is merely a jackpot that increases in value over time.

A progressive controller typically carries out the calculation of the progressive jackpot value and the monitoring of won jackpots, as well as linking the contributing gaming machines. The progressive controller monitors the coin-in and jackpot information of each gaming machine to determine the monetary amount being wagered as well as whether the progressive jackpot has been won. This information is then used by the controller to increment the progressive jackpot value and to report the incremented value to a display visible to all of the players of the linked machines. In some progressive systems, the value of the progressive jackpot is also displayed on each of the individual linked machines. Once a win of the progressive jackpot occurs, the progressive controller acknowledges and logs the win and resets the jackpot value to a base amount for continuing progression based on subsequent play.

For example, in a system of three slot machines contributing 10 cents to a progressive jackpot for each handle pull of the slot machine, the progressive controller monitors the three slot machines and adds 10 cents to the progressive jackpot each time it detects a handle pull at any of the three slot machines. The progressive controller stores a base progressive jackpot amount of $1M and increases the jackpot amount based on the activity at the linked slot machines, as described above. The progressive jackpot is won when one of the linked machines "hits" the winning jackpot combination. The winning jackpot combination is merely an outcome that is pre-defined to be a win. It can be a particular number on a roulette wheel, a particular hand in a card game or three cherries on a slot machine.

In the above example, the progressive controller continuously monitors the linked slot machines for the occurrence of the winning jackpot combination as well as for handle pulls. Once it determines that the winning jackpot combination has been hit at one of the machines, it awards the current value of the progressive jackpot to the player of the machine at which the winning jackpot combination has been hit. The progressive controller then resets the progressive jackpot amount to the base value of $1M.

There are various ways in which the awarding of a progressive jackpot may be determined. One way is to add a percentage of value wagered on each of the machines contributing to a base jackpot value until the winning jackpot combination is hit by a player at one of the linked gaming devices. The player operating the gaming device upon which the jackpot winning combination occurred is awarded the value of the jackpot at the time of the win. The value of the jackpot is paid out to the winner and the jackpot is reset to the base jackpot value. In some systems, a portion of the value of the jackpot at the time of the win at one of the linked machines is allocated between the players at the other gaming machines (e.g. the winning player receives 80% of the jackpot and the remaining 20% is apportioned amongst the players at the other linked machines).

For example, assume a jackpot base value is $1M. A bank of 10 slot machines are hooked up to the progressive jackpot, each contributing 1 cent for every handle pull. Eventually the jackpot gets up to $2,645,097.99. A player at one of the slot machines linked to the progressive jackpot hits the progressive jackpot winning combination of bar—bar—bar. The winner receives the $2,645,097.99, the jackpot is reset to $1M and the progression starts all over again.

While progressive jackpot systems have proved satisfactory in stimulating game play on the linked gaming machines, it has been observed that game play tends to decrease immediately after the progressive jackpot has been won. Game play typically does not increase until after the displayed current progressive jackpot value increases considerably above the initially reset base value. This fall-off in game play results from players being reluctant to initiate game play until the current jackpot increases because they believe that the value will likely increase to a more substantial level before a win occurs. Also, since a win on a progressive system happens infrequently (sometimes as infrequently as once every couple of years), there is very little incentive for players to compete to win the progressive bonus in the time period immediately following a win because they erroneously perceive a cyclical pattern in the probability of winning (i.e. once a win has occurred, another win will not occur for some time). Thus, believing that another payout will not occur for some time, in addition to wanting to wait until the jackpot gets bigger so that their resultant awarded prize will be bigger, discourages players from playing during the time period right after the win. Fall-off in game play at any time is undesirable and detracts from the benefits of the progressive gaming system.

Thus, what is needed is a means to maintain the incentive to continue to play the progressive jackpot gaming system at all times and to reduce the fall-off in game play after a progressive jackpot win.

SUMMARY OF THE INVENTION

It is an object of the present invention to enable a progressive jackpot system that overcomes the drawbacks of existing progressive jackpot systems by making game play attractive to the players at all times and avoiding the fall-off period after a win of the jackpot. The present invention provides a progressive jackpot system that remains equally attractive and exciting to players both right before and right after a win of the progressive jackpot, as well as during the time between wins.

In the progressive jackpot system of the present invention, the players that hit the jackpot winning combination are initially awarded the base value of the progressive jackpot rather than the current amount. The progressive nature of the jackpot system does not affect a player's winning amount until after the win takes place. A player who wins the progressive jackpot of this invention receives a payout equal to the base value of the jackpot and subsequently continues to earn a percentage of the coins wagered at each of the machines linked to the progressive jackpot from his win until the next win.

For example, the player may get a penny per handle pull at each of the linked machines. Thus, the player does not know the total amount of the progressive jackpot he has won until the subsequent win of the jackpot by another player. Once a win occurs, the player that had previously won, receives the value of the current jackpot less the base value of the jackpot. This amount is the accumulated jackpot value. Meanwhile, the current winner initially only receives the base value of the jackpot.

The value of the progressive jackpot is reset to the base value after each win. This system overcomes the disadvantages of the prior art progressive systems because players are motivated to play for the base amount of the jackpot with their win at one of the linked machines, without regard to the current value of the jackpot. Thus players are not discouraged from playing if the current value happens to be low. An additional benefit of the present system, not present in the prior art systems, is that a player who has already won the progressive jackpot will not necessarily discontinue playing subsequent to the win. In fact, the player that has won the jackpot may be encouraged to play with the thought that he is contributing to his future wealth by playing (since a percentage of his wagers is being added to the progressive jackpot amount that will eventually be his). The player may also actively encourage others to play the linked gaming machines contributing to the jackpot in an effort to increase his future earnings from the progressive jackpot.

These and other features and advantages of the present invention will be understood upon consideration of the following detailed description of the invention and the accompanying drawings.

BRIEF DESCRIPTION OF THE DRAWINGS

FIG. 3 is a tabular illustration of a winner database according to an example embodiment of the present invention.

FIG. 4 is a tabular illustration of a player database according to an example preferred embodiment of the present invention.

FIG. 8 is a tabular illustration of a player database according to an alternate example embodiment of the present invention.

DETAILED DESCRIPTION OF THE PREFERRED EMBODIMENTS

The present invention is preferably embodied as a computer program developed using an object oriented language that allows the modeling of complex systems with modular objects to create abstractions that are representative of real world, physical objects and their interrelationships. However, it would be understood by one of ordinary skill in the art that the invention as described herein can be implemented in many different ways using a wide range of programming techniques as well as general purpose hardware systems or dedicated controllers.

A system embodying the present invention sets a progressive jackpot at an initial base value and increments the progressive jackpot in response to game play at linked gaming machines. Once a player wins the progressive jackpot, he is paid the base value of the jackpot. The system stores the winning player's identifying information and resets the value of the jackpot to the base amount. The system monitors and increments the progressive jackpot until another win occurs. Once the subsequent win occurs, the system determines the current value of the progressive jackpot and splits it between the current winner and the previous winner. Thus, the current winner is paid the base value of the jackpot and the previous winner is paid the current jackpot amount less the base jackpot amount. The current winner's identifying information is then stored within the system so that he can be paid the remainder of his winnings, whatever they will be, upon the subsequent winning of the jackpot by another winner.

Figure 1:
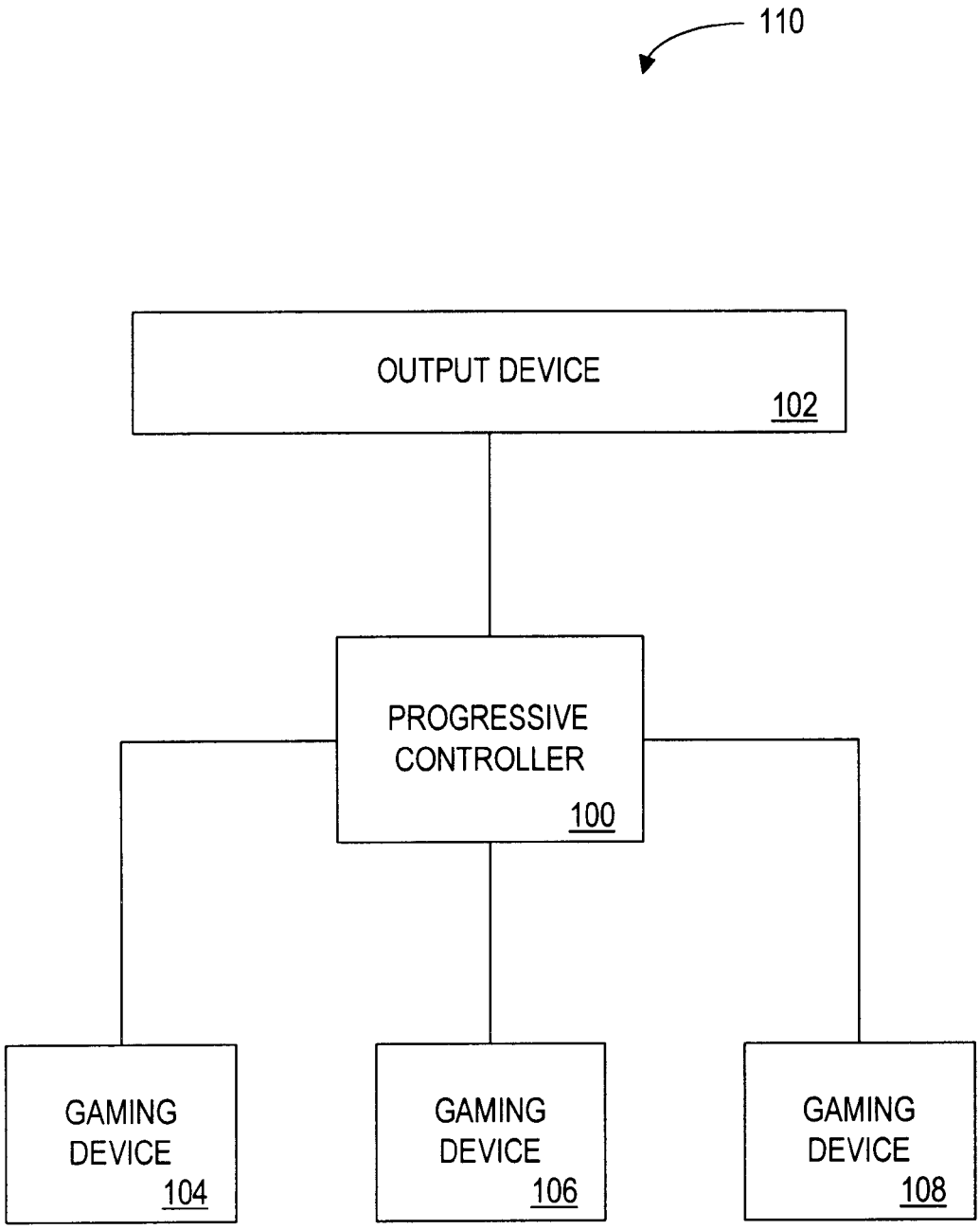
FIG. 1 is a block diagram overview of a gaming system according to an example embodiment of the present invention.

An example of a system embodying the present invention is pictured in FIG. 1. A gaming system 110, according to the present invention includes a progressive controller 100 coupled to one or more gaming devices 104, 106 and 108 (only three are shown in FIG. 1 for illustrative purposes). The progressive controller 100 can be implemented as a dedicated hardware circuit, a programmed general purpose computer, or any other functionally equivalent configurable electronic, mechanical, or electromechanical device. The gaming devices 104, 106 and 108 can likewise be implemented as dedicated hardware circuits, programmed general purpose computers, or any other functionally equivalent configurable electronic, mechanical, or electromechanical devices. One or more output devices 102 in the form of video displays, electro-luminescent arrays, liquid crystal display panels, printers, or functionally equivalent devices, are coupled to the progressive controller 100 and are operable to display information regarding the status of a jackpot being computed in the progressive controller 100. In addition, or alternatively, an output device 102 can be embodied within one or more of the gaming devices 104, 106 and 108.

In operation, the progressive controller 100 calculates the current value of the progressive jackpot based on "coin-in" or other "play transaction" information received from the gaming devices 104, 106 and 108 and displays the value on the output device 102 for the players. The gaming devices 104, 106 and 108 and the output device 102 can be connected to the progressive controller 100 in any number of ways including the use of the Internet, a local area network (LAN), a telephone system, or any functionally equivalent communications protocol. In addition, the gaming devices 104, 106 and 108 can be coupled to each other either directly or through the progressive controller 100.

In a casino-based preferred embodiment, a casino based gaming system 110 is implemented as a network of gaming devices 104, 106 and 108 such as slot machines, poker machines and blackjack games connected to a dedicated progressive controller 100. In this embodiment, the output device 102 is implemented as a large panel display that can easily be seen by players located at any of the gaming devices 104, 106 and 108.

In a second preferred embodiment, an internet based gaming system 110 is implemented as a server computer system, functioning as the progressive controller 100, that allows any number of users operating remote terminals or personal computers running software that provides gaming device 104, 106 and 108 functionality, to connect to the server via the Internet or a LAN. In this embodiment, the output device 102 is preferably implemented as a subset of the display on the terminal or personal computer that is serving as the gaming device 104, 106 and 108.

Figure 2:
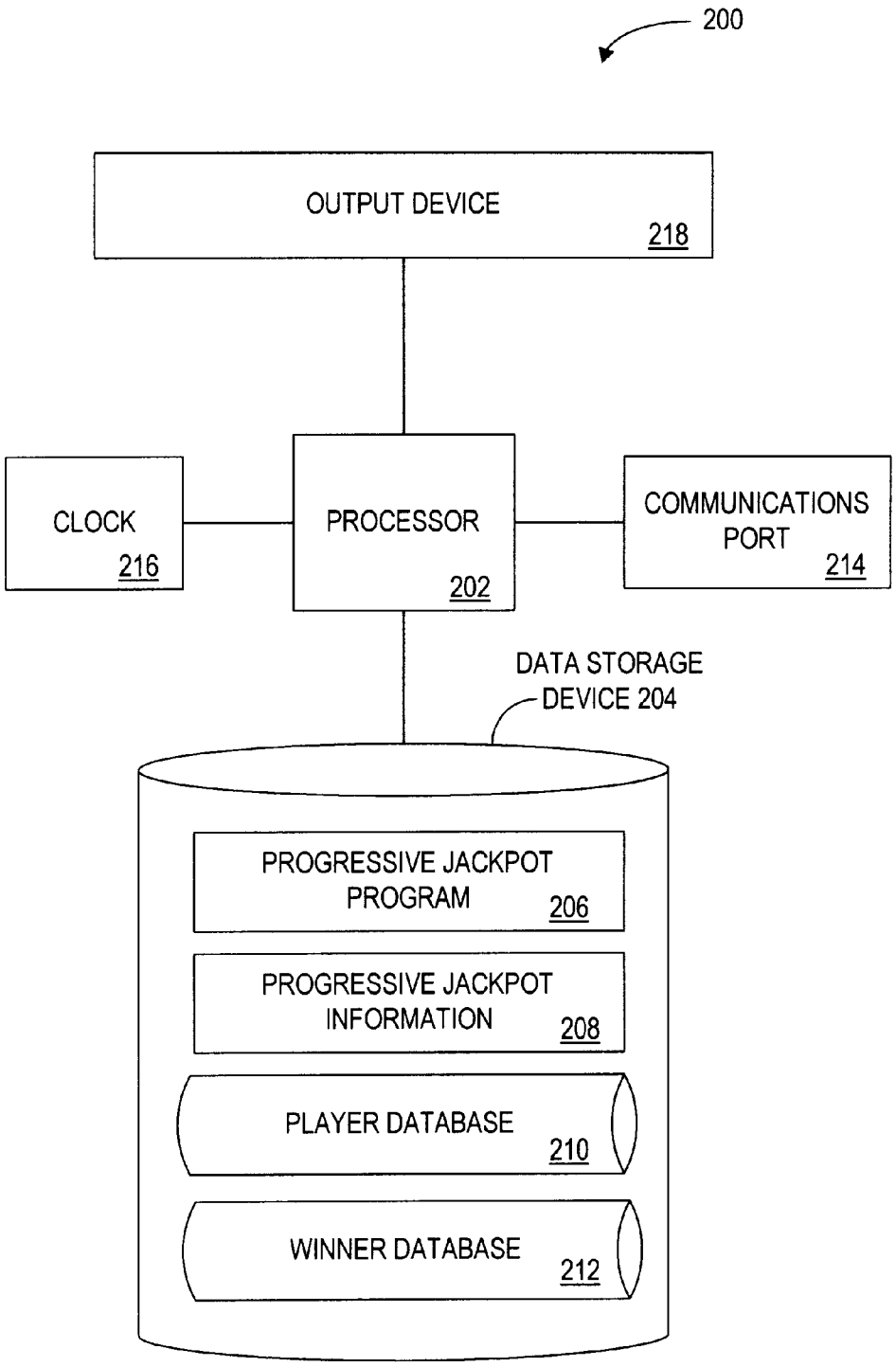
FIG. 2 is a block diagram of a progressive controller according to an example embodiment of the present invention.

Turning to FIG. 2, a progressive controller 200 (corresponding to the progressive controller 100 of FIG. 1) includes a processor 202 coupled to a data storage device 204, a communications port 214, and a clock 216. As an alternative to the embodiment pictured in FIG. 1, the progressive controller 200 of FIG. 2 includes an integral output device 218. The processor 202 can be implemented as a general purpose, programmable microprocessor, an application specific integrated circuit, or any functionally equivalent device operable to control the progressive jackpot system in accordance with the present invention and to implement the progressive jackpot determinant methods described below.

The progressive controller 200 includes a clock 216 for determining the date and time of a win as well as for time related calculations in alternative embodiments described below. The processor 202 communicates with the gaming devices 104, 106 and 108 linked to it via the communications port 214. The communications port 214 is preferably implemented using a T1 communications board, a serial port and modem, a LAN adapter, or any functionally equivalent processor communications system.

The data storage device 204 is preferably implemented using a persistent memory system. Such a system may include random access memory, hard drives and/or other electronic or magneto-optical data recording sub-systems.

In a preferred embodiment, where the processor 202 is a general purpose microprocessor, the data storage device 204 stores a progressive jackpot program 206 which includes instructions for executing the progressive jackpot determinant methods described below, on the processor 202. The progressive jackpot program 206 also includes instructions for managing the progressive jackpot, such as how much to increment the progressive jackpot and when (e.g. by 10 cents for every handle pull of a linked gaming device) as well as the steps to carry out in the case of a win of the jackpot. In other words, the processor 202 is operable to load and run the progressive jackpot program 206. In the embodiment of FIG. 2, the progressive jackpot program 206 stores data accumulated, or computed by, the processor 202 on the data storage device 204. This stored data is preferably organized and indexed in one or more related relational databases 208, 210, 212.

In the example embodiment illustrated in FIG. 2, the related relational databases include a progressive jackpot information repository 208, a player database 210, and a winner database 212. The progressive jackpot information repository 208 stores the current value of the jackpot and associated information such as a base jackpot value. The player database 210 stores identifiers, and associated information, representative of players of the gaming devices 104, 106 and 108 of FIG. 1. Likewise, the winner database 212 stores identifiers, and associated information, representative of winning players of the gaming devices 104, 106 and 108 of FIG. 1.

Turning to FIG. 3, a simple example embodiment of the winner database 212 of FIG. 2 is depicted. One of ordinary skill in the art would recognize that the database 212 of FIG. 3 could contain any number of records and that only three are shown for illustrative purposes. Whenever a progressive jackpot win occurs at one of the linked gaming devices 104, 106 and 108 of FIG. 1, the win information is recorded in the winner database 212. The preferred embodiment of a winner database 212 includes a winner identifier field 300, a machine identifier field 302, a time of win field 304, a base value field 306, an accumulated value field 308, and a total jackpot win field 310. The winner identifier field 300 stores a unique identifier for each particular winning player. In the example winner database 212 shown, three different winners are listed: "1234", "9843" and "2574". The machine identifier field 302 stores a unique identifier for each particular gaming device or machine upon which a winning player won. This identifier might be, for example, a serial number of a slot machine, the address of an Ethernet LAN adapter, or an Internet protocol address. In the example winner database 212 shown, three different machines, "156247", "562348", and "259987", are listed corresponding to the listed winners "1234", "9843" and "2574" respectively.

The time of win field 304 stores the dates in which winning players won. In the example winner database 212 shown, three different times, "Jul. 21, 1995", "Mar. 18, 1995", and "Jun. 20, 1998", are listed corresponding to the listed winners "1234", "9843" and "2574" respectively. The base value field 306 stores the amount of base value contained in the progressive jackpot at the time a player won the jackpot. It is this amount that is awarded to a winning player at the time of the win. In the example winner database 212 shown, three base values, $1,000,000.00, $1,000,000.00, and $1,000,000.00, are listed corresponding to the listed winners "1234", "9843" and "2574" respectively. The base value field 306 entries in the pictured example embodiment is a constant amount. However, it is contemplated that the base value could be varied in the alternative embodiments described below.

In the preferred embodiment, the accumulated value field 308 stores the amount of value that had accumulated in the progressive jackpot at the time a subsequent player won the jackpot. In accordance with the different embodiments described in detail below the accumulated value field 308 may be updated in a player's record by the progressive controller 200 (i) once the progressive jackpot is won by the next player; (ii) as the current jackpot value is being updated; or (iii) cyclically. In the example winner database 212 shown, two accumulated values, "$1,208,995.00" and "$2,593,118.00" are listed corresponding to the listed winners "1234" and "9843" respectively. According to one embodiment of the invention, the accumulated value is not determined until a subsequent winner actually wins. Thus, the accumulated value field 308 for winner number "2574" is listed as "Pending." In an alternative embodiment, the accumulated value field 308 stores a current accumulated value for a record that corresponds to a winner still waiting for a subsequent winner to win. In yet another alternative embodiment, the accumulated value field 308 stores a current accumulated value for a record that corresponds to a winner waiting for subsequent cycles of winners to win.

Finally, the total jackpot win field 310 stores the sum of the corresponding base value field 306 and the accumulated value field 308. In the example winner database 212 shown, two total jackpot win values, "$2,208,995.00" and "$3,593,118.00" are listed corresponding to the listed winners "1234" and "9843" respectively. As mentioned above, according to one embodiment of the invention, the accumulated value is not determined until a subsequent winner actually wins. Thus, the total jackpot win field 310 for winner number "2574" cannot yet be computed and is therefore listed as "N/A." In the two alternative embodiments mentioned above, the accumulated value field 308 stores a current accumulated value for a record that corresponds to a winner waiting for one or more subsequent winners to win. In these two cases, the total jackpot win field 310, would actually reflect the "total jackpot won to date" instead of the total amount that player ultimately won.

The following specific example based on the example values found in FIG. 3 is provided only to illustrate the operation of the system. In this particular example, the initial base value of a jackpot is set at $1M. The jackpot progresses by accumulating one cent for every handle pull of each of the slot machines connected to the progressive jackpot system. The jackpot eventually reaches $3,593,118, at which point Dean Green wins the jackpot. Dean Green initially receives the $1 million base value. The remaining portion, the accumulated value of $2,593,118 goes to the previous progressive jackpot winner, Damascus Lek. Damascus Lek's total winnings are now $3,593,118. Dean Green then waits to see what the total amount of his winnings will be (i.e. the value in the progressive jackpot less the base amount at the time of the next win). The jackpot is reset to the base amount after Dean Green's win and Damascus Lek's payout. The jackpot starts accumulating value in the same manner as before. The current situation described above is reflected in the example values of FIG. 3.

Turning to FIG. 4, a simple example embodiment of the player database 210 of FIG. 2 is depicted. As with the database shown in FIG. 3, one of ordinary skill in the art would recognize that the database of FIG. 4 could contain any number of records and that only three are shown for illustrative purposes. The player database 210 contains pertinent information about each player that has won a progressive jackpot. The preferred embodiment of a player database 210 includes a player identifier field 400 (corresponding to the winner identifier field 300 for the player in the winner database 212), a name field 402, a preferred contact method field 404, an update frequency field 406, a social security number field 408, and a status field 410. The player identifier field 400 stores a unique identifier for each particular player. In the example player database 210 shown, three different players are listed: 1234, 9843 and 2574. Note that these happen to be the same three individuals listed in the winner database 212 of FIG. 3. In the present invention, the entries in the winner database 212 preferably correspond to the entries in the player database 210.

The name field 402 stores the name of the player. In the example player database 210 shown, three different name field 402 entries are listed, "Bob Lowe", "Damascus Lek", and "Dean Green" corresponding to the player identifier field 400 entries, 1234, 9843 and 2574, respectively. The preferred contact method field 404 stores information required to contact a player in a preferred manner as specified by the player. This information is for contacting the player once the next win occurs in order to inform him of his accumulated jackpot amount. In the example player database 210 shown, three different preferred contact method field 404 entries are listed, a postal address: "10 Main St., Town, USA"; an email address: "LEK@AOL.COM"; and a telephone number: "(555)705-9999", each corresponding to a respective player identifier field 400 entry, 1234, 9843 and 2574.

In accordance with an alternative embodiment of the invention, a player who has won a progressive jackpot may opt to receive payout of the current accumulated amount of the jackpot at a pre-determined rate (e.g. once per day). For example, rather than having to wait to receive the remainder of his winnings once another player wins the progressive jackpot, an "active" winner may opt to receive one check per day for the amount that the progressive system has earned for him that day. The system would continue to display the total progressive jackpot to the players but the amount to payout to the active winner per day would be tracked. Any desired frequency for making these update payouts can be used. In this alternative embodiment, the frequency of the updating payouts may be stored in the player database 210 associated with a player identifier and may be either player or casino specified. More specifically, within the player database 210 the update frequency field 406 stores the time period for providing payout updates. In the example player database 210 shown, three update frequency field 406 entries are listed, "1/week", "1/day", and "1/week", each corresponding to a respective player identifier field 400 entry, 1234, 9843 and 2574.

The social security number field 408 stores a universally recognized/government issued personal identification number such as a United States Social Security Number of the player. In the example player database 210 shown, three social security number field 408 entries are listed, "111-55-5632", "112-94-4762", and "113-43-8314", each corresponding to a respective player identifier field 400 entry, 1234, 9843 and 2574.

A player's status (i.e. whether he is currently accumulating his progressive jackpot and is active, or has already collected his entire winnings and is inactive) may also be stored in this database. This information is stored in the status field 410. In the example player database 210 shown, three status field 410 entries are listed, "INACTIVE", "INACTIVE", and "ACTIVE", each corresponding to a respective player identifier field 400 entry, 1234, 9843 and 2574.

Figure 5:
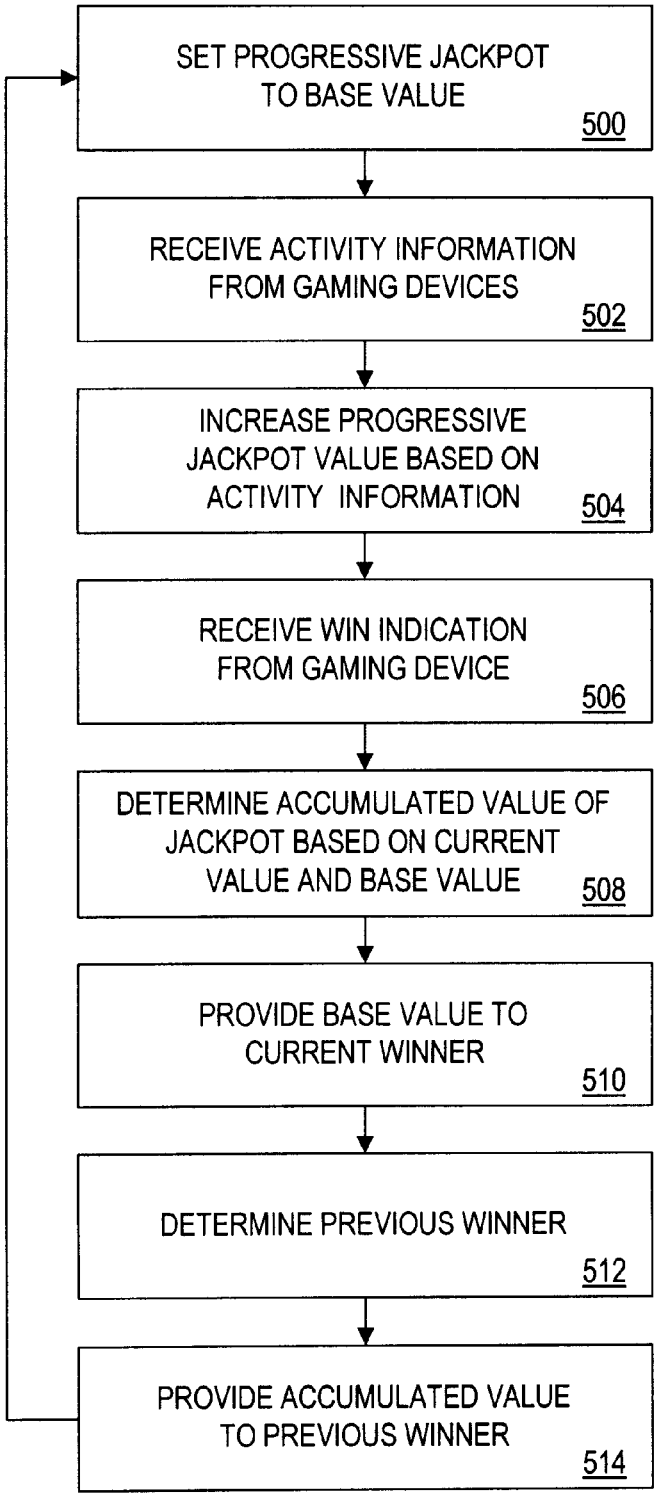
FIG. 5 is a process flowchart illustrating an example embodiment of the method of the present invention.

FIG. 5 is a process flowchart illustrating an example embodiment of the method the present invention. In Step 500, the progressive jackpot value stored in the progressive jackpot information repository 208 is set to a base value. The base value is preferably equal to an amount that will encourage players to play but it could also be equal to zero. In Step 502, the progressive controller 200 receives play activity information from the linked gaming devices 104, 106, 108. The play activity information represents wagering transactions occurring on the gaming devices 104, 106, 108, and thus, an amount that the value in the progressive jackpot should be incremented. The jackpot is incremented or "progressed" in Step 504.

In an alternative embodiment, the progressive jackpot value can be incremented or decremented based upon the play activity information. For example, the jackpot might progress by an increment of 10 cents for every dollar wagered on each slot machine connected to the gaming system 110. However, the progressive jackpot could also be configured to "progress" by a decrement of 2 cents for every dollar won on each slot machine. It should be understood that the term "progress" as used herein, particularly with respect to the value in a jackpot, only means "changing over time" and does not necessarily mean "increasing over time."

Figure 6A:
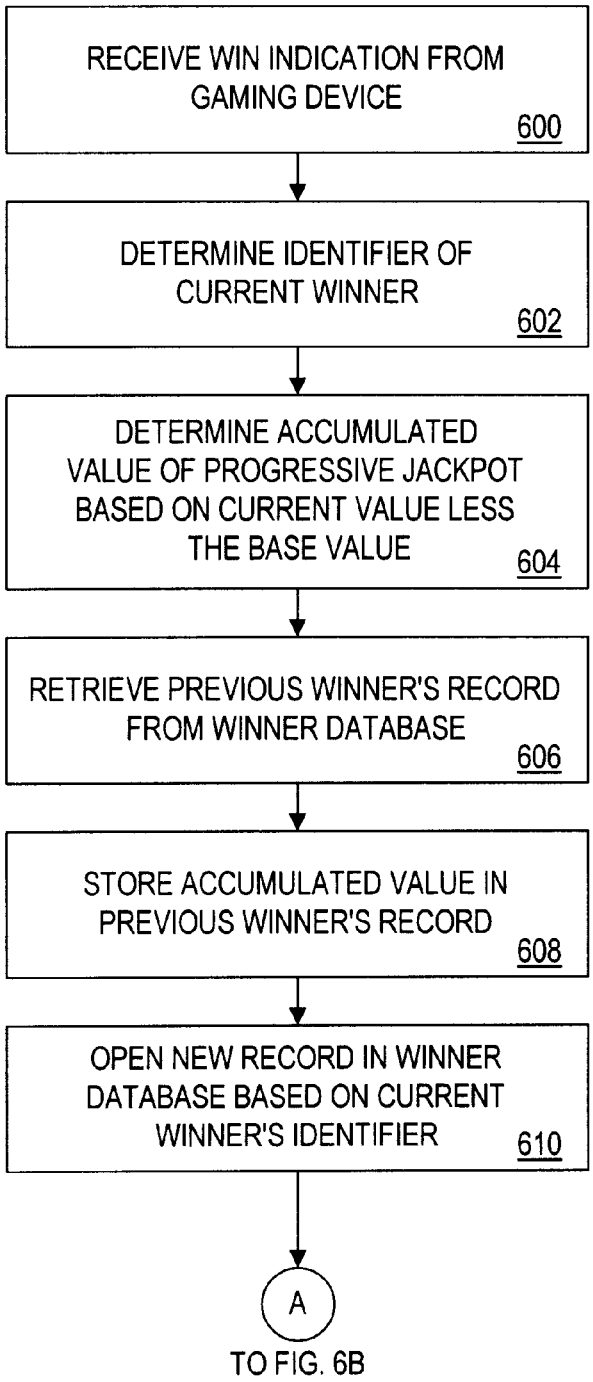
FIGS. 6A and 6B is a more detailed process flowchart illustrating an example embodiment of a portion of the method illustrated in FIG. 5.
Figure 6B:
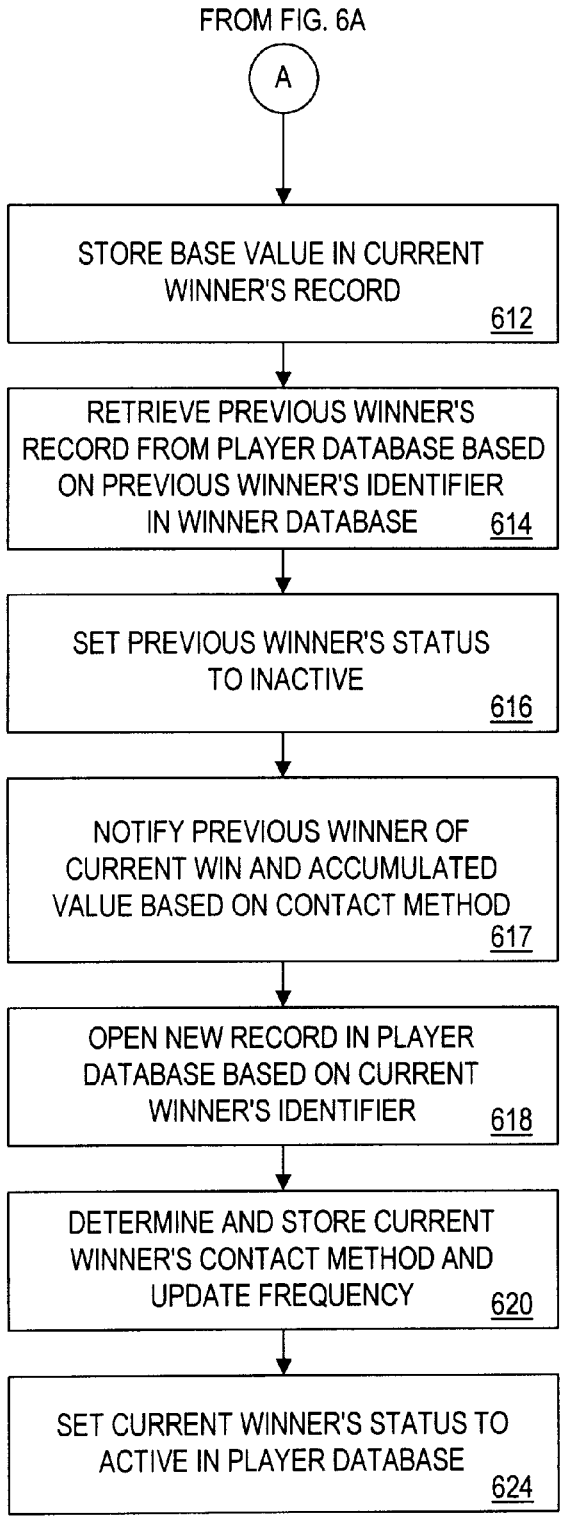

In Step 506, the progressive controller 200 receives a progressive jackpot win indication from one of the linked gaming devices 104, 106, 108. In Step 508, an accumulated value is calculated based upon the difference between the current value of the jackpot and the base value set in Step 500. In Step 510, the base value is paid out to the player at the gaming device that sent the progressive controller 200 the win indication. In Step 512, the previous winner of the progressive jackpot is determined and in Step 514 the accumulated value as calculated in Step 508 is paid out to the previous winner identified in Step 512. Turning to FIGS. 6A and 6B, the details of Steps 506 through 514 of FIG. 5 are illustrated. More generally, FIGS. 6A and 6B illustrate an example of the method of providing the appropriate portions of the progressive jackpot to the current and previous winner at the time of a win. In Step 600, the progressive controller 200 receives a progressive jackpot win indication from one of the linked gaming devices 104, 106, 108. The player at the winning gaming device provides the pertinent information (e.g. name and Social security number) that will eventually be stored in the player database 210 and a player identifier is associated with the player's information. In Step 602, the winner identifier is determined from the gaming device that sent the progressive jackpot win indication. In Step 604, the processor 202 calculates the accumulated value of the progressive jackpot by subtracting the base value from the current value. Recall that the base value and the current value are stored on the data storage device 204 in the progressive jackpot information repository 208.

In Step 606, a database look-up is performed in the winner database 212 and the previous winner's record is retrieved. In Step 608, the accumulated value of the progressive jackpot, as calculated in Step 604, is stored in the accumulated value field 308 of the winner database 212. In Step 610, a new record is created in the winner database 212. The player identifier determined in Step 602 is written into the winner identifier field 300 of the new record in the winner database 212. Appropriate values are also entered into the machine identifier field 302 and the date of win field 304 of the new record in the winner database 212.

In Step 612, the base value is entered into the base value field 306 of the new record in the winner database 212. In Step 614, the previous winner's record is retrieved from the player database 210 using the identifier in the winner identifier field 300 of the previous winner in the winner database 212. In Step 616, the previous winner's status field 410 in the player database 210 is set to "INACTIVE." In Step 618, the previous winner is notified of the current win and the accumulated value using the preferred contact method information found in the preferred contact method field 404 in the player's record in the player database 210.

In Step 620, a new player record is created in the player database 210 using the current winner's identifier for the entry in the player identifier field 400. The player's information is also stored in the name field 402 and the social security number field 408 at this point. In Step 622, the current winner's preferred contact method and update frequency are determined from the winner and stored in the preferred contact method field 404 and update frequency field 406 respectively, of the new player record in the player database 210. Finally, in Step 624, the current winner's status field 410 in the new player record of the player database 210 is set to "ACTIVE."

In an alternative embodiment of the present invention, a player can specify either (1) a time condition that determines what accumulated value he receives and/or (2) a wager he is willing to make regarding the accumulated value on a certain future date. In the first variation, the player can specify that he would rather receive the accumulated value at some specified future date, whatever it may be, rather than the accumulated value in the progressive jackpot at the time the next player wins.

In the second variation, the player can specify that instead of receiving the accumulated value in the progressive jackpot at the time the next player wins, he would rather risk losing the accumulated value in exchange for the possibility of winning twice the accumulated value if the jackpot gets up to a certain specified value within a certain specified time period. In this variation, the range of specified times and values that the player could choose would preferably be restricted to allow the gaming system 100 to remain profitable but still provide legitimate odds of winning. Also in this variation, the player could be allowed to wager only a portion of the accumulated value and/or the award amount for winning could be varied with the amount of risk the player is willing to take in specifying the wager.

This embodiment also allows a player to specify a time condition that determines what accumulated value he receives, a wager he is willing to make regarding the accumulated value on a certain future date, and a delay period for any payout. This is a compound variation of the two variations described above. In this variation, the player specifies a time condition (e.g. "I want the jackpot 6 months from now" or ". . . if jackpot gets up to $X by in Y amount of time") and progressive jackpot specifications (e.g. "the value of the jackpot six months from now is paid out to me" or "double my jackpot if the value gets up to $X within Y time"). The progressive controller 200 stores these specifications in association with the player identifier and, if the player wins the progressive jackpot, the jackpot is not paid out immediately. Instead, the progressive controller 200 waits until the time condition of the player occurs (e.g. a six month period) and then pays the jackpot to the player based on the conditions specified by the player.

Figure 7:
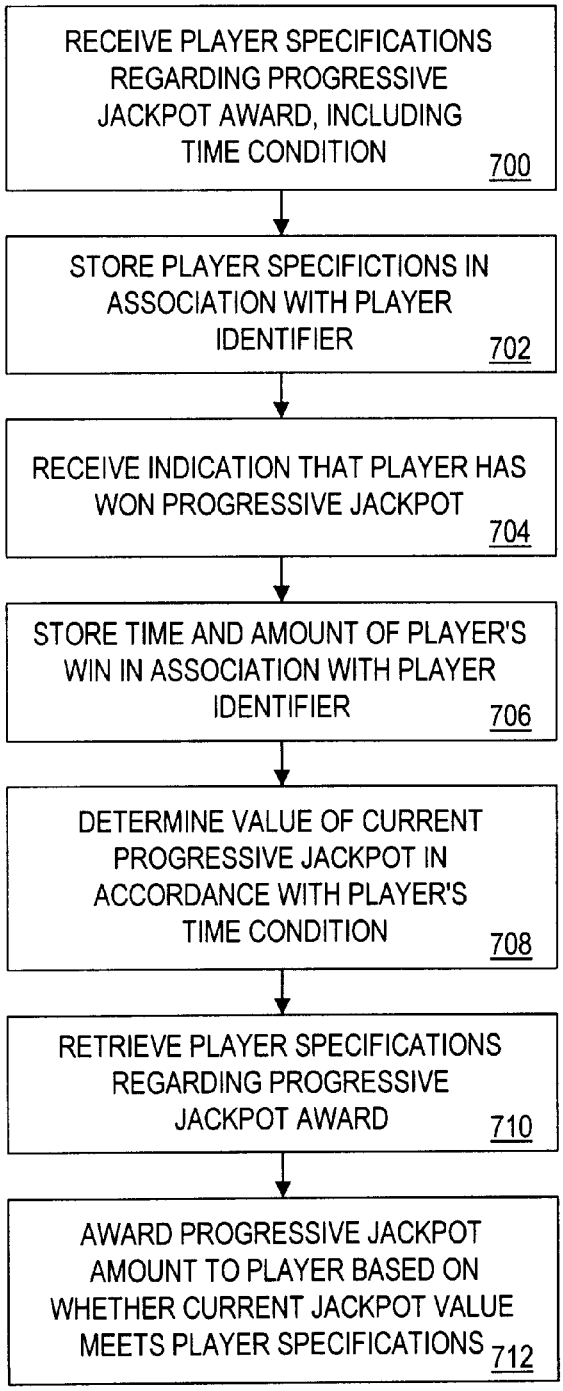
FIG. 7 is a process flowchart illustrating an alternative example embodiment of a portion of the method of the present invention.

FIG. 7 is a process flowchart of the foregoing alternate embodiment of the method of the present invention. In Step 700, the player inputs his specifications regarding the progressive jackpot award. As described above, these specifications can include time, time and value, and/or wager amounts. In Step 702, the player's specifications are stored either as an additional field appended to the player's record in the player database 210 or in a separate award specification database (not pictured) that is both related to the other databases and indexed by the player identifiers.

In Step 704, the processor 202 receives an indication that the player has won the progressive jackpot. In Step 706, the time of the win, which may include a time of day and/or a date, and the amount of the player's win are stored in the player database 210 in the record corresponding to the player's identifier. In Step 708, the value of the current progressive jackpot is determined in accordance with the time condition specified by the player. In Step 710, the player specifications regarding the progressive jackpot award are retrieved from the player database 210 (or the award specification database.) Finally, in Step 712, the player is awarded a jackpot amount based upon whether the current progressive jackpot value meets the player specifications. In another embodiment of the present invention, a player who has won the progressive jackpot can specify the date he would like to receive his payout of the accumulated value. However, in this variation, if a subsequent player wins the progressive jackpot before the first winner requests his payout, the first winner forfeits his jackpot. In the case that the first winner does request his payout before the subsequent win, any value accumulated in the progressive jackpot between the date the first winner requested payout and the subsequent win can be added to the base value of the of the next progressive jackpot. Alternatively, any value accumulated in the progressive jackpot between the date the first winner requested payout and the date of the subsequent win can be paid out to the players that are playing at the time of the subsequent win.

In another embodiment of the invention, a first progressive jackpot winner can receive a payout from several progressive jackpots won by others subsequent to the first winner. In other words, winners are awarded money for more than one cycle of the progressive jackpot. This is done by decreasing the percentage of the awards with each cycle. Thus, once a player hits the winning jackpot combination he waits to see how much he will earn based on subsequent wins.

For example, a winning player receives the base amount at the time of his win. He then waits until the next win and receives 70% of the accumulated value at the time of the subsequent win. In this embodiment, the player continues to receive awards even after the win subsequent to his win. He receives 20% of the accumulated jackpot upon the second subsequent win and 10% of the accumulated value upon the third subsequent win. The percentages and number of cycles mentioned in this example are merely for illustrative purposes, clearly many other combinations could be used. FIG. 8 is a tabular illustration of an example alternative player database 210A useful for controlling the alternate embodiment of the invention. The alternative player database 210A allows the processor 202 to track the portions of the progressive jackpot owed to the various previous winners and the current winner at the time of a win of the progressive jackpot. In this example database, only three cycles are supported as described above. However, one of ordinary skill would readily recognize that additional fields could be added to support as many cycles as desired. The example alternative player database 210A pictured includes a player identifier field 800, a base value field 802, a first subsequent cycle winnings (70%) field 804, a second subsequent cycle winnings (20%) field 806, a third subsequent cycle winnings (10%) field 808, and a total progressive jackpot to date field 810.

The player identifier field 800 and the base value field 802 are equivalent to the fields of the same name pictured in FIG. 3. The subsequent cycle winning fields 804, 806, 808 store the values paid out for each player after each subsequent win and the total progressive jackpot to date field 810 stores the current total amount paid out to the player associated with a given record.

Based on the example values in FIG. 8, Player 1234 has received a base value amount and two subsequent awards (70% and 20%). He is waiting for a fourth player to win (not pictured) in order to receive his final award of 10% of the accumulated value at the time the fourth player wins the progressive jackpot. Player 9843 has received a base value amount and one subsequent award (70%). Player 9843 is waiting for the fourth winner in order to receive his next award of 20% of the accumulated value at the time the fourth player wins the progressive jackpot. Finally, Player 2574 has only received the base value amount and he is waiting for the fourth winner in order to receive his award of 80% of the accumulated value at the time the fourth player wins the progressive jackpot. Thus, when a fourth player wins, Player 2574 will get 70% of the value accumulated in the progressive jackpot, Player 9843 will get 20% and Player 1234 will get 10%.

While the method and apparatus of the present invention has been described in terms of its presently preferred and alternate embodiments, those skilled in the art will recognize that the present invention may be practiced with modification and alteration within the spirit and scope of the appended claims. The specifications and drawings are, accordingly, to be regarded in an illustrative rather than a restrictive sense.

Further, even though only certain embodiments have been described in detail, those having ordinary skill in the art will certainly understand that many modifications are possible without departing from the teachings thereof. All such modifications are intended to be encompassed within the following claims.

What is claimed is:

1. A method for determining a jackpot comprising the steps of:

detecting an occurrence of a first win condition of a first player;

detecting an occurrence of a second win condition of a second player;

setting the jackpot to a base value;

progressing a jackpot during a time between the first win and the second win;

and outputting a monetary amount, the monetary amount being based on a value of the progressed jackpot, to the first player.

2. A method for determining a jackpot comprising the steps of:

detecting an occurrence of a first win condition of a first player;

detecting an occurrence of a second win condition of a second player;

progressing a jackpot during a time between the first win and the second win;

outputting a monetary amount, the monetary amount being based on a value of the progressed jackpot, to the first player;

and outputting separately a base value portion of the progressed jackpot when a win condition occurs.

3. The method of claim 2 wherein the base value portion of the progressed jackpot is output to the second player and the remainder of the progressive jackpot is output to the first player.

4. A method for determining a jackpot comprising the steps of:

detecting an occurrence of a first win condition of a first player;

detecting an occurrence of a second win condition of a second player;

progressing a jackpot during a time between the first win and the second win;

outputting a monetary amount, the monetary amount being based on a value of the progressed jackpot, to the first player;

and resetting the progressed jackpot to a base value after the second win condition occurs.

5. A method for determining a jackpot comprising the steps of:

detecting an occurrence of a first win condition of a first player;

detecting an occurrence of a second win condition of a second player;

progressing a jackpot during a time between the first win and the second win, wherein incrementing the jackpot based upon play activity on a gaming device;

and outputting a monetary amount, the monetary amount being based on a value of the progressed jackpot, to the first player.

6. A method for determining a jackpot comprising the steps of:

detecting an occurrence of a first win condition of a first player;

detecting an occurrence of a second win condition of a second player;

progressing a jackpot during a time between the first win and the second win, wherein displaying the value of the jackpot as it progresses;

and outputting a monetary amount, the monetary amount being based on a value of the progressed jackpot, to the first player.

7. A method for determining a jackpot comprising the steps of:

detecting an occurrence of a first win condition of a first player;

detecting an occurrence of a second win condition of a second player, wherein receiving a win indication from a gaming device;

progressing a jackpot during a time between the first win and the second win; and outputting a monetary amount, the monetary amount being based on a value of the progressed jackpot, to the first player.

8. A method for determining a jackpot comprising the steps of:

detecting an occurrence of a first win condition of a first player;

detecting an occurrence of a second win condition of a second player;

progressing a jackpot during a time between the first win and the second win;

outputting a base value portion of the progressed jackpot for the second win condition when the second win condition is detected;

and outputting a monetary amount, the monetary amount being based on a value of the progressed jackpot, to the first player.

9. The method of claim 8 wherein the step of outputting a monetary amount for the first win condition includes outputting a monetary amount based on the value of the progressed jackpot less the base value portion of the jackpot.

10. A method for determining a jackpot comprising the steps of:

identifying a first condition;

deferring a payout of a jackpot for the first condition until a second condition occurs, wherein the payout amount is determined upon the occurrence of the second condition.

11. The method of claim 10 including the step of progressively increasing the jackpot.

12. The method of claim 10 including the step of determining the payout amount based upon an amount the jackpot has changed between the occurrence of the first and second conditions.

13. The method of claim 10 including the step of initially setting the jackpot to a base value.

14. The method of claim 10 including the step of paying out a base value portion of the jackpot for a given condition when the given condition occurs.

15. The method of claim 14 including the step of resetting the jackpot to the base value when the given condition occurs.

16. The method of claim 10 including the step of paying out the jackpot for the first condition when the second condition occurs.

17. A method for determining a jackpot comprising the steps of:

identifying the occurrence of a first condition;

progressing a jackpot until a second condition occurs, wherein the jackpot is initially set to a base value; and determining a payout for the first condition based on the progression of the jackpot.

18. A method for determining a jackpot comprising the steps of:

identifying the occurrence of a first condition;

progressing a jackpot until a second condition occurs, wherein a base value portion of the progressive jackpot is paid out for a given condition when the given condition occurs;

and determining a payout for the first condition based on the progression of the jackpot.

19. A method for determining a jackpot comprising the steps of:

identifying the occurrence of a first condition;

progressing a jackpot until a second condition occurs; and determining a payout for the first condition based on the progression of the jackpot, wherein the step of determining the payout for the first condition includes computing the amount the jackpot has changed between the occurrence of the first and second conditions.

20. A method for determining a jackpot comprising the steps of:

identifying the occurrence of a first condition;

progressing a jackpot until a second condition occurs;

setting the jackpot to an initial value;

and determining a payout for the first condition based on the progression of the jackpot.

21. The method of claim 20 including the step of paying out an initial value of the jackpot for a given condition when the given condition occurs.

22. The method of claim 21 including the step of resetting the jackpot to the initial value when the given condition occurs.

23. A method for determining a jackpot comprising the steps of:

identifying the occurrence of a first condition;

progressing a jackpot until a second condition occurs;

determining a payout for the first condition based on the progression of the jackpot;

and paying out the jackpot for the first condition when the second condition occurs.

24. A method for determining a jackpot comprising the steps of:

identifying the occurrence of a first condition;

progressing a jackpot until a second condition occurs;

determining a payout for the first condition based on the progression of the jackpot;

and paying out the jackpot for the first condition as the jackpot progresses.

25. The method of claim 24 wherein the step of paying out the jackpot for the first condition includes paying out the jackpot in periodic installments as the jackpot progresses.

26. A method for determining a jackpot comprising the steps of:

setting a progressive jackpot to a base value;

incrementing the progressive jackpot based upon play information received from at least one gaming device;

receiving an indication of a win condition from a gaming device played by a current winner;

determining an accumulated value of the progressive jackpot based upon a current value and the base value;

providing the base value to the current winner; and providing the accumulated value to a previous winner.

27. The method of claim 26 wherein the step of providing the accumulated value includes providing the accumulated value to the previous winner as the value accumulates.

28. The method of claim 27 wherein the step of providing the accumulated value includes providing the accumulated value to the previous winner in periodic installments as the value accumulates.

29. A method for determining a jackpot comprising the steps of:

setting a progressive jackpot to a base value;

receiving play information from at least one gaming device;

incrementing the progressive jackpot based upon the play information from the gaming devices;

receiving an indication of a first win condition from a first winning gaming device;

providing the base value to a player of the first winning gaming device;

resetting the progressive jackpot to the base value;

repeating steps of receiving play information and incrementing the progressive jackpot until an indication of a second win condition from a second winning gaming device;

providing the progressive jackpot, less the base value, to the player of the first winning gaming device; and providing the base value to a player of the second winning gaming device.

30. A method for determining a jackpot comprising the steps of:

setting a jackpot to a base value;

determining a current value of the jackpot;

receiving a win indication;

computing an increased value of the jackpot based upon the base value and current value;

distributing the base value of the jackpot to a current winner;

distributing the increased value of the jackpot to a previous winner; and resetting the progressive jackpot to the base value.

31. The method of claim 30 wherein the step of determining a current value of the jackpot includes the step of receiving play activity information from at least one gaming device and progressively incrementing the jackpot based upon the play activity information.

32. A method for paying out a jackpot comprising the steps of:

setting a jackpot value to a base value;

receiving wager information from at least one linked gaming device;

incrementing the jackpot value based on the wager information to determine a current jackpot value;

receiving a win indication from a linked device;

determining an identity of a first winner;

storing the identity of the first winner in a winner database;

dispensing the base value of the jackpot value to the first winner;

resetting the jackpot value to the base value;

repeating the steps of receiving wager information and incrementing the jackpot value until a second win indication is received from a linked gaming device, thereby determining a second winner;

determining an identify of the second winner;

storing the identity of the second winner in the winner database;

retrieving the identity of the first winner from the winner database;

determining the current jackpot value;

determining an earned progressive value based on the base value and the current jackpot value;

paying out the earned progressive value to the first winner;

paying out the base value to the second winner;

repeating the method at the step of resetting the jackpot value.

33. A method for determining a jackpot comprising the steps of:

identifying the occurrence of a win condition;

progressing a jackpot until a predefined condition occurs, wherein the predefined condition includes a specified time period; and determining a payout for the win condition based on the progress of the jackpot until the predefined condition.

34. A method for determining a jackpot comprising the steps of:

identifying the occurrence of a win condition;

progressing a jackpot until a predefined condition occurs; and determining a payout for the win condition based on the progress of the jackpot until the predefined condition, wherein the predefined condition includes the jackpot progressing up to a specified value.

35. A method for determining a jackpot comprising the steps of:

identifying the occurrence of a win condition;

progressing a jackpot until a predefined condition occurs; and determining a payout for the win condition based on the progress of the jackpot until the predefined condition, wherein the predefined condition includes the jackpot progressing up to a specified value within a specified time period.

36. The method of claim 35 including the step of increasing the payout by a first predefined amount if the predefined condition is met and reducing the payout by a second predefined amount if the predefined condition is not met.

37. A method for determining a jackpot comprising the steps of:

identifying the occurrence of a first win condition of a player;

progressing a jackpot value until either a second win condition occurs or the player requests a payout; and paying the player either a value accumulated in the progressing jackpot or nothing based upon whether the player requested a payout before the second win condition occurred.

38. The method of claim 37 further including the step of setting the jackpot value to a base value.

39. The method of claim 38 wherein value that accumulates in the progressing jackpot after the player requests a payout is added to the base value when the second win condition occurs.

40. The method of claim 38 wherein value that accumulates in the progressing jackpot after the player requests a payout is paid to at least one current player playing when the second win condition occurs.

41. A method for determining a jackpot comprising the steps of:

detecting an occurrence of a win condition;

progressing a progressive jackpot until a subsequent win condition occurs;

outputting a jackpot for the win condition equal to a portion of the progressive jackpot; and outputting at least one jackpot for previous win conditions equal to portions of the remaining progressive jackpot.

42. The method of claim 41 wherein the jackpot that is output for a given win condition each time a subsequent win condition occurs, represents a predefined percentage of the progressive jackpot and wherein the predefined percentage that is output declines with each subsequent occurrence of a win condition.

43. A method for determining a jackpot comprising the steps of:

detecting an occurrence of an active win condition;

accumulating value in a progressive jackpot until a subsequent win condition occurs;

paying out a jackpot value for the active win condition equal to a portion of the value accumulated in the progressive jackpot; and paying out a plurality of jackpots for win conditions that occurred previous to the active win condition, wherein the sum of the jackpot amounts paid out are equal to the accumulated value remaining in the progressive jackpot.

44. The method of claim 43 wherein the jackpot that is paid out for a given win condition each time a subsequent win condition occurs, represents a predefined percentage of the value of the progressive jackpot and wherein the predefined percentage that is paid out declines with each subsequent occurrence of a win condition.

45. The method of claim 43 including the step of paying out a base value portion of the progressive jackpot for the subsequent win condition when the subsequent win condition occurs.

46. The method of claim 45 wherein the paying out of a jackpot value for the active win condition is paid to a player playing when the active win condition occurred, wherein the paying out of the plurality of jackpots for win conditions that occurred previous to the active win condition is paid to a plurality of players playing when the previous win conditions occurred, and wherein the paying out of a base value portion of the progressive jackpot for the subsequent win condition is paid to a player playing when the subsequent win condition occurred.

47. An apparatus for determining a jackpot comprising:

a controller coupled to a gaming device for computing a progressive jackpot, the controller including circuitry for paying out the progressive jackpot to a winner when a subsequent winner wins.

48. The apparatus of claim 47 further including a database coupled to the controller for storing identifiers of the winners and related information.

49. The apparatus of claim 48 wherein the related information includes information regarding jackpot value on the date of the win.

50. The apparatus of claim 48 wherein the related information includes at least one of a gaming device identifier, a date of win, a base value, and an accumulated value for each winner identifier.

51. The apparatus of claim 47 further including a database coupled to the controller for storing identifiers of the players and related information.

52. The apparatus of claim 51 wherein the related information includes information regarding player status information.

53. The apparatus of claim 51 wherein the related information includes at least one of a player name, contact information, an update frequency, and a social security number for each player identifier.

54. The apparatus of claim 51 wherein the related information includes, for each player identifier, at least one subsequent cycle winnings jackpot percentage value.

55. The apparatus of claim 54 wherein the related information further includes a base jackpot value.

56. An apparatus for determining a jackpot comprising:

a controller coupled to a gaming devices for computing a progressive jackpot, the controller including circuitry for deferring payout the progressive jackpot to a winner until a predefined condition is satisfied; and a database coupled to the controller for storing identifiers of the winners and related information.

57. The apparatus of claim 56 wherein the related information includes information regarding jackpot value on the date of the win.

58. The apparatus of claim 56 wherein the related information includes at least one of a gaming device identifier, a date of win, a base value, and an accumulated value for each winner identifier.

59. An apparatus for determining a jackpot comprising:

a controller coupled to a gaming devices for computing a progressive jackpot, the controller including circuitry for deferring payout the progressive jackpot to a winner until a predefined condition is satisfied; and a database coupled to the controller for storing identifiers of the of the players and related information.

60. The apparatus of claim 59 wherein the related information includes information regarding player status information.

61. The apparatus of claim 59 wherein the related information includes at least one of a player name, contact information, an update frequency, and a social security number for each player identifier.

62. The apparatus of claim 59 wherein the related information includes, for each player identifier, at least one subsequent cycle winnings jackpot percentage value.

63. The apparatus of claim 62 wherein the related information further includes a base jackpot value.

64. A gaming system comprising:

a controller;

a storage device coupled to the controller; and software operative to run on the controller to defer payout a progressive jackpot to a winner until a predefined condition is satisfied, wherein the predefined condition includes the occurrence of a second win condition subsequent to a first win condition.

65. A gaming system comprising:

a controller;

a storage device coupled to the controller, wherein the storage device includes a database for storing an identifier of a winner and related information; and software operative to run on the controller to defer payout a progressive jackpot to a winner until a predefined condition is satisfied.

66. The system of claim 65 wherein the related information includes information regarding jackpot value on the date of a win.

67. The system of claim 65 wherein the related information includes at least one of a gaming device identifier, a date of win, a base value, and an accumulated value for each winner identifier.

68. A gaming system comprising:

a controller;

a database coupled to the controller for storing identifiers of the players and related information;

a storage device coupled to the controller; and software operative to run on the controller to defer payout a progressive jackpot to a winner until a predefined condition is satisfied.

69. The system of claim 68 wherein the related information includes information regarding player status information.

70. The system of claim 68 wherein the related information includes at least one of a player name, contact information, an update frequency, and a social security number for each player identifier.

71. The system of claim 68 wherein the related information includes at least one subsequent cycle winnings jackpot percentage value for each player identifier.

72. The system of claim 71 wherein the related information further includes a base jackpot value.

73. A gaming system comprising:

a controller;

a plurality of gaming devices coupled to the controller and operable to allow players to compete for the progressive jackpot;

a storage device coupled to the controller; and software operative to run on the controller to defer payout a progressive jackpot to a winner until a predefined condition is satisfied.

74. The system of claim 73 wherein the plurality of gaming devices provide user interfaces to the players that are operable to display information about the progressive jackpot.

75. A gaming system comprising:

a controller;

a storage device coupled to the controller;

software operative to run on the controller to defer payout a progressive jackpot to a winner until a predefined condition is satisfied; and an output device for displaying information about the progressive jackpot.

76. A gaming system comprising:

a controller, wherein the controller includes a clock, an input port and an output port and wherein the storage device contains a player database and a winner database;

a storage device coupled to the controller; and software operative to run on the controller to defer payout a progressive jackpot to a winner until a predefined condition is satisfied.

77. A computer readable medium for use in a jackpot determination system, the computer readable medium storing a computer program comprising the processing steps of:

identifying a first win condition; and deferring a payout of a jackpot for the first win condition until a second condition occurs, wherein the payout amount is determined upon the occurrence of the second condition.

78. An information medium for use in a jackpot determination system, the information medium having recorded thereon a computer program comprising the processing steps of:

identifying a first win condition; and deferring a payout of a jackpot for the first win condition until a second condition occurs, wherein the payout amount is determined upon the occurrence of the second condition.

79. An information transmission medium for use in a jackpot determination system, the information transmission medium transmitting a computer program comprising the processing steps of:

identifying a first win condition; and deferring a payout of a jackpot for the first win condition until a second condition occurs, wherein the payout amount is determined upon the occurrence of the second condition.

80. A computer data signal representative of controller instructions comprising the processing steps of:

identifying a first win condition; and deferring a payout of a jackpot for the first win condition until a second condition occurs, wherein the payout amount is determined upon the occurrence of the second condition.

* * * * *